United States Patent [19]

Kempe

[11] 4,167,651

[45] Sep. 11, 1979

[54] MIXING TWO SIGNALS DERIVED FROM AN AUDIO SOURCE WITHOUT OSCILLATION

[75] Inventor: Robert B. Kempe, Janesville, Wis.

[73] Assignee: O. C. Electronics, Inc., Milton, Wis.

[21] Appl. No.: 835,179

[22] Filed: Sep. 20, 1977

[51] Int. Cl.[2] ..... H04R 3/00

[52] U.S. Cl. ..... 179/1 J; 179/1 GP

[58] Field of Search ..... 179/1 J, 1 GP, 100.1 TD

[56] References Cited

U.S. PATENT DOCUMENTS

| | | | |
|---|---|---|---|
| 3,060,266 | 10/1962 | Dow | 179/1 G |
| 3,066,187 | 11/1962 | Taylor et al. | 179/1 G |
| 3,251,942 | 5/1966 | Madsen | 179/1 J |
| 3,725,586 | 3/1973 | Iida | 179/1 GP |
| 3,939,305 | 2/1976 | Crooks | 179/1 J |
| 4,002,835 | 1/1977 | Bumber | 179/1 GP |

OTHER PUBLICATIONS

M. Schroeder, "An Artificial Sterophonic Effect", J. And. Eng. Soc., Apr. 1958, pp. 74–79.

*Primary Examiner*—Kathleen H. Claffy
*Assistant Examiner*—E. S. Kemeny
*Attorney, Agent, or Firm*—Laurence R. Brown

[57] ABSTRACT

The reverberation system loudspeaker is fed at one terminal by the direct signal and at the opposite terminal by the delayed signal such that the loudspeaker impedance forms part of the feedback path.

10 Claims, 8 Drawing Figures

FIG. 1
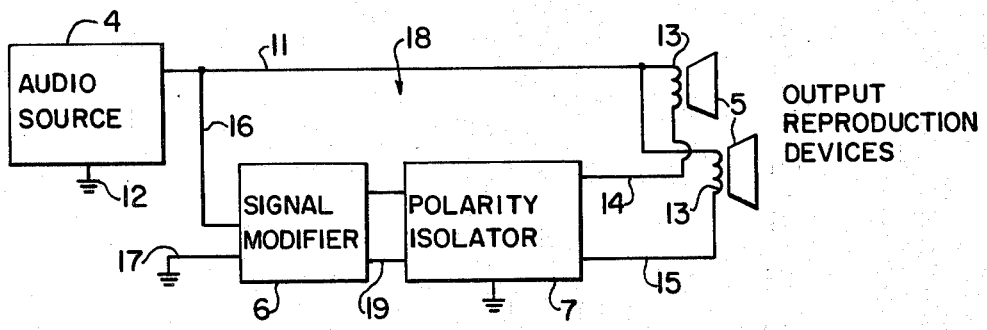
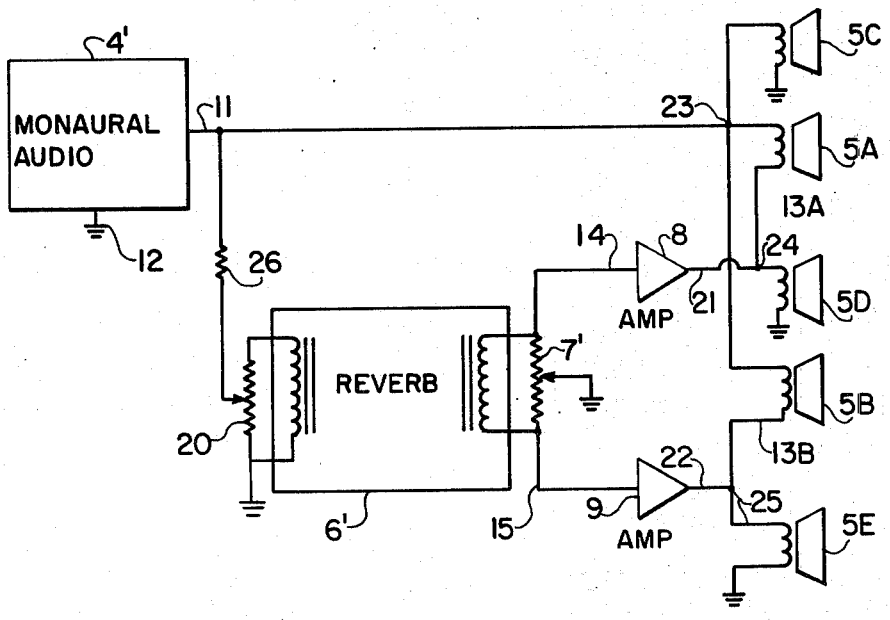
FIG. 2D

MIXING TWO SIGNALS DERIVED FROM AN AUDIO SOURCE WITHOUT OSCILLATION

This invention relates to audio systems mixing two signals derived from the same audio source and more particularly it relates to reverberation sound systems.

BACKGROUND OF THE INVENTION

Reverberation systems are well known in the art. For example, Hammond et al. U.S. Pat. No. 2,942,070, June 21, 1960, provides for mixing two signals derived from a single audio source, where one signal is modified by a reverberator to simulate stereophonic effect in a monaural system.

Madsen U.S. Pat. No. 3,251,942, May 17, 1966 and Dow U.S. Pat. No. 3,333,061, June 25, 1967, provide for reverberation in stereophonic systems with a single reverberation unit. The Madsen patent outlines the significant problem of oscillation when a reverberation feedback link causes two signals derived from the same source to be commonly amplified.

Other systems such as shown in Laube U.S. Pat. No. 3,463,868, Aug. 26, 1969 and Byles U.S. Pat. No. 3,259,691, July 5, 1966 separately process the basic audio and derived reverberation signals to different output speakers.

Some of the problems with these prior art systems include the inflexibility of the systems to adapt to circumstances (1) where both mixed and separate reverberated and basic signals are desired at various speaker locations, and (2) where a reverberation unit and amplifier may be added to a standard radio unit without access to or changes in internal wiring. These basic prior art systems also are not adaptable for use in both monaural and stereophonic applications without significant change.

For example, in an automobile radio system it might be desirable to add reverberation either to a rear speaker of a monaural system or both rear speakers of a stereo system while operating the front speaker circuits only by the basic audio output of the radio, or to mix the signals in any or all speakers. Also it is desirable to retrofit by merely replacing the existing speakers with a reverberation unit without necessitating changes in internal wiring of the standard radio.

Also, for use to simulate an auditorium environment, the prior art systems are not efficient in providing minimal equipment and a single reverberating unit for example to provide stereophonic sound where speakers are placed around the audience to reproduce on sides and the rear sound with reverberation only or with mixed in reverberation and to reproduce at front center the signals without reverberation.

In particular, when mixing the two signals derived from the same audio source, it is desirable to prevent feedback of the signals so that distortion with probable oscillation is induced, and this is desirable simultaneously with improvement of the foregoing deficiencies. Thus, a most critical part of any reverberation system is the mixing circuitry which must combine the two related signals and process them after combination in a manner eliminating distortion and oscillation.

OBJECTS OF THE INVENTION

It is accordingly a general object of this invention to provide improved dual audio channel signal processing circuits improving the status of the prior art.

A more specific object of this invention is to provide unique and simplified non-critical mixing circuitry for two related audio signals permitting reproduction with minimal distortion or oscillation.

Another object of this invention is to provide a simplified flexible reverberation sound system adaptable to monaural and stereophonic signals to produce variously reverberated, partly-reverberated and non-reverberated signals at different reproducing devices locatable in different positions.

Still another object of this invention is to provide a stereophonic reverberation system with a single reverberator device in a unit that can replace a standard speaker assembly without any additional rewiring.

Other features, objectives and advantages will be found throughout the following specification.

BRIEF DESCRIPTION OF THE INVENTION

Therefore in accordance with this invention a speaker, or other output reproduction device, is replaced by a self-contained unit processing a basic audio input signal and a modified signal derived therefrom such as a reverberation signal and mixing the two signals at a common reproduction device, such as a speaker.

To isolate the two channels and prevent feedback introducing distortion or oscillation, the two signals are mixed by introduction respectively at two opposed terminals of the output reproduction device to thereby feed the signals through the common circuit such as a speaker voice coil in opposing directions.

A single reverberation device is used for stereophonic reproduction, and the basic self-contained unit serves in the same manner for coupling to either monaural or stereophonic audio sources, such as radios, phonographs or tape decks.

The unit permits connection of extra speakers at will to reproduce the basic signal from the source or the reverberated signal without mixing in addition to the mixed two signals, thereby simulating auditorium effects and serving for example to carry the mixed signals only to the rear speaker system in automobile radio systems.

THE DRAWING

In the drawing, similar and related elements are referenced by the same basic characters throughout the various views to facilitate comparison.

FIG. 1 is a schematic block diagram of a generalized audio signal modification and mixing system embodying the invention, FIGS. 2A–D are schematic block diagrams of monaural reverberation systems embodying the invention, and FIGS. 3 and 3A are schematic block diagrams of stereophonic reverberation systems embodying the invention.

DETAILED DESCRIPTION OF THE INVENTION

Figure 2:
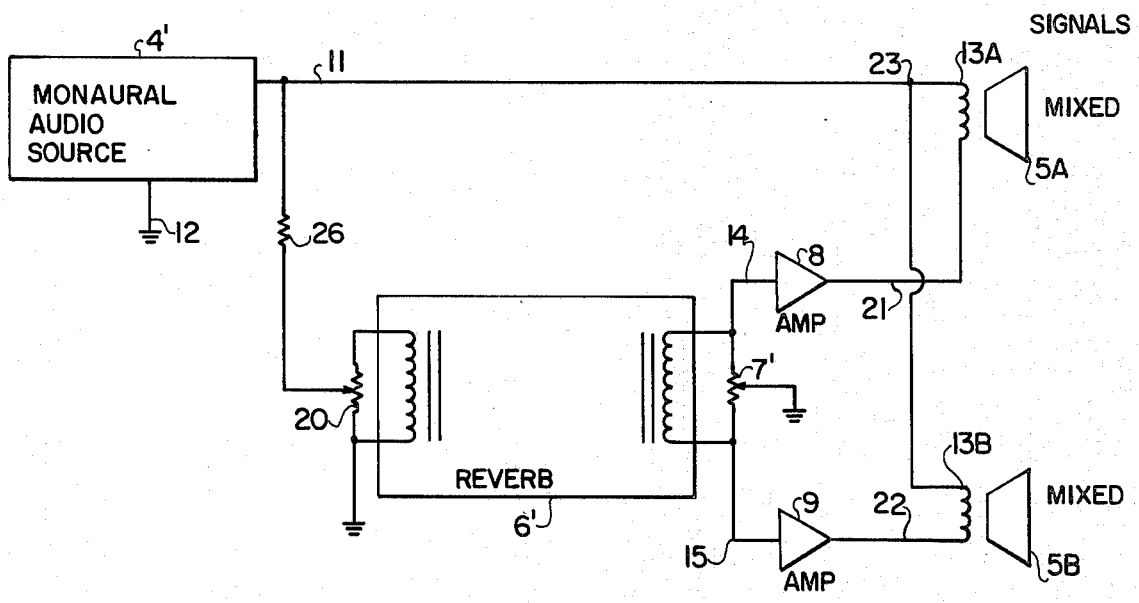

The general nature of the invention and its mode of operation may be understood by reference to the block diagram of FIG. 1. Any conventional audio source 4, well known in the art, such as a radio, phonograph or tape deck, will provide basic audio signals by way of leads 11, 12 to output reproduction devices 5, such as speakers, earphones, or transmitters, having signal responsive input impedance members 13 that typically are speaker voice coils.

A second audio channel derives the same audio basic signal and modifies it in element 6, which may be for example a filter, a tone control circuit or a reverberation device. Output signals from the signal modifier are made available by polarity isolator 7 in a phase relationship at leads 14, 15 so that they are fed through impedance member 13 in an opposite direction, and for all practical purposes are fully dissipated in impedance member 13 as are the basic audio signals mixed thereby for common reproduction. Accordingly, the impedances 13 are simple, convenient mixers at a critical circuit position, since the modified signal at 14, 15 is not fed back into the loop formed by leads 11, 12 and signal modifier input terminals 16, 17 in such a way to introduce feedback distortion or oscillation, which otherwise would be likely particularly if the signal modification channel amplifies the signal derived from the basic audio output leads 11, 12, Thus, this circuit arrangement does not produce simultaneous amplification of modified and basic signals, but rather isolates the basic signal to flow in one channel 18, namely through the leads 11, 12 to the reproduction device 5 and further isolates the modified audio signal to flow through channel 19, without commonly amplifying both signals in the same channel. Should output amplification of the modified audio signal be desirable, amplifiers 8, 9 are inserted in leads 14, 15 as shown in the remaining embodiments, and thereby they amplify only the modified audio signal derived in channel 19.

It is to be noted that the signal modification and mixing embodiments of this invention provide the desirable feature of being self-contained units interspersed in leads 11 and 12 only between the audio source 4 and reproduction device 5. Thus, no changes of any kind, or internal wiring provisions need be made in the standard audio source 4 to retrofit the system, other than to remove the output reproduction devices 5, normally speakers, and plug in the unit between the audio source speaker terminals and the speakers (5).

The embodiment of FIG. 2 illustrates the self-contained adaptor unit used in a monaural system to introduce reverberation, and FIGS. 2A–D illustrate the flexibility afforded by the system in adding various speakers at chosen locations to reproduce various effects by mixing and isolating reverberation and basic signals. Thus, the signal modifier is a conventional reverberation device 6' such as a delay line, well known in the art.

To isolate the output polarity with leads 14, 15 presenting signals of opposite phase, the isolator comprises potentiometer 7' having a sliding tap grounded so that the two oppositely phased signals at leads 14 and 15 may be balanced, if necessary. Input potentiometer 20 provides a control for the amount of reverberation to be produced in the signal modification channel. The value of resistor 28 is selected to be equal to the impedance 13A.

Amplifiers 8 and 9 provide for amplitude and power losses in the reverberator 6', and are adjusted to provide for each speaker 5A, 5B, etc., the same power output produced by output amplifiers in the audio source 4' at leads 11, 12.

In accordance with this invention therefore the speaker coils 13A and 13B are connected as mixer-isolators. Thus, the basic audio signal at lead 11 is connected to the top of coils 13A and 13B and the modified signals at leads 21, 22 are connected at the bottom of these respective coils. Therefore, the monaural radio 4' can feed two speakers 5A and 5B with mixed basic and modified audio signals derived from the same audio source without causing distortion or oscillation from the common reproduction of the two related signals.

This system is further advantageous in providing significant flexibility in attaining an auditorium effect. That is, front center speakers may use the basic audio only, side speakers may use mixed basic audio-reverberated signals and rear speakers may use only the reverberated signals.

Accordingly, at terminal 23 is connected optional speaker 5C with its voice coil grounded at the other end. This speaker then reproduces only the basic audio signal provided by radio 4', etc. Similarly opposite phases of the reverberation signal alone is coupled to optional grounded voice coil speakers 5D and 5E at respective terminals 24, 25. This same arrangement can be used with the stereophonic system of FIG. 3 with additional options of choosing right and left channels for placement of appropriate speakers and signals.

Figure 3:
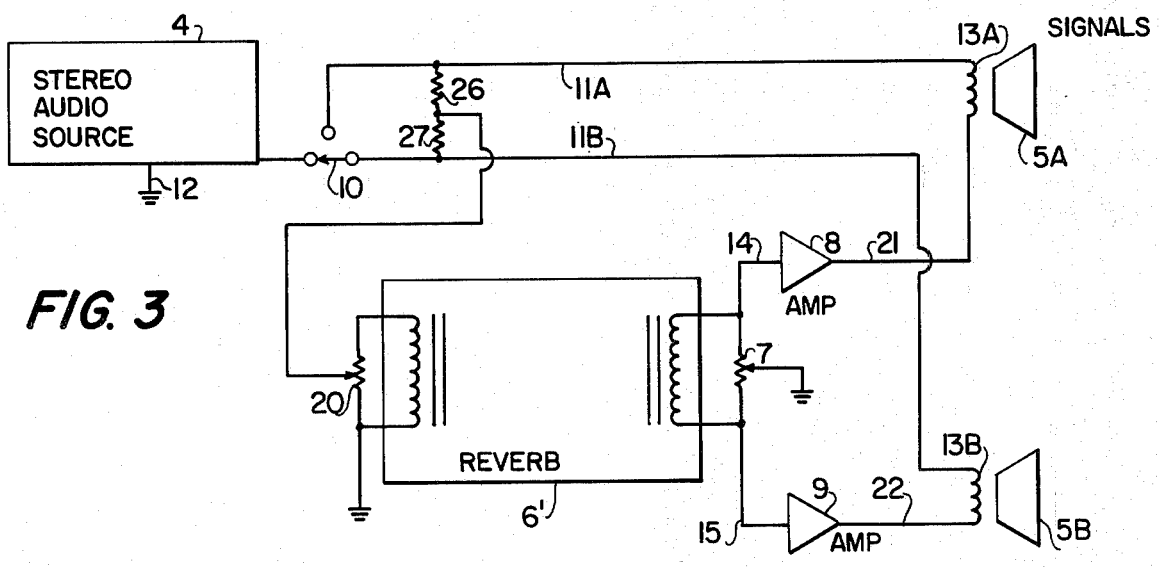

In FIG. 3, the same self-contained unit arrangement is used with the exception that the stereophonic signal is taken off by resistor matrix 26, 27 coupled between the two stereophonic output leads 11A, 11B referenced to common ground lead 12. It is evident therefore that the stereophonic reverberated signals are then referenced by amplifiers 8 and 9 respectively to mix with the basic stereo signals in corresponding channels at speaker voice coils 13A, 13B in the manner aforesaid.

Figure 3A:
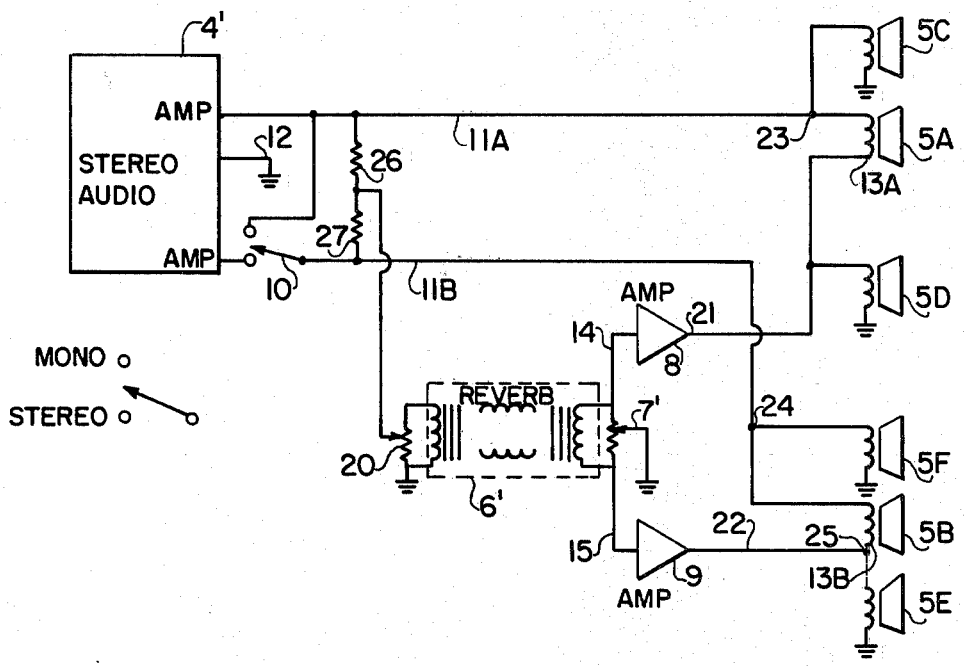
Figure 2A:
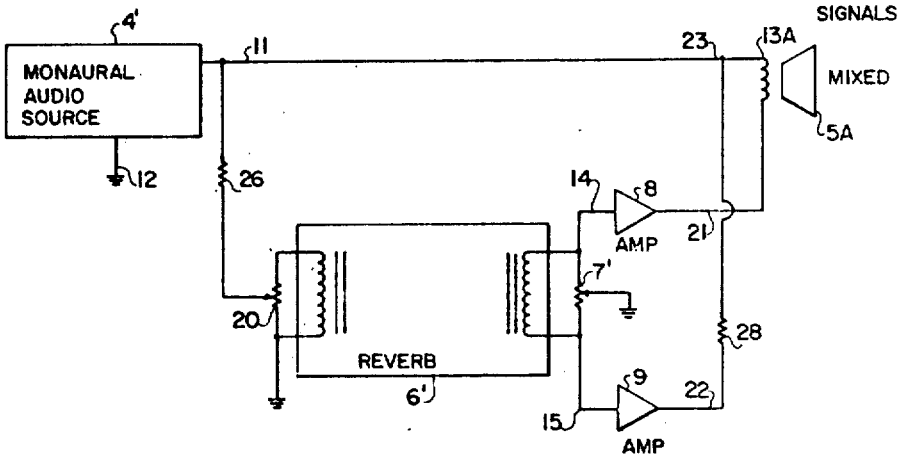
Figure 2B:
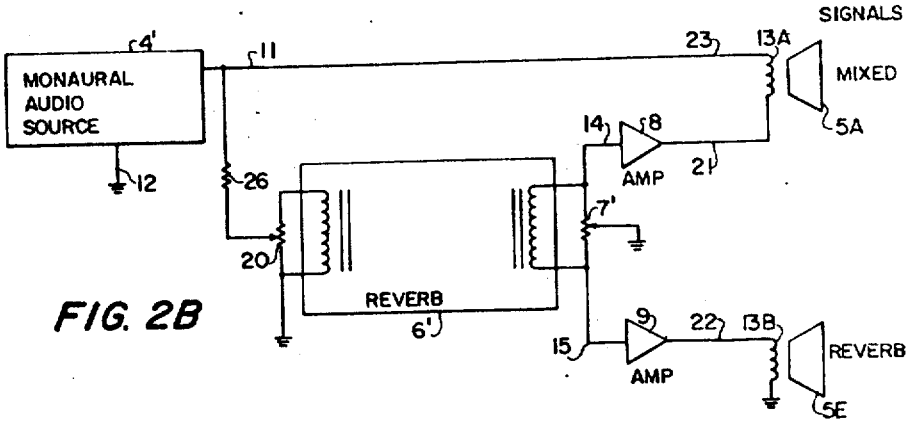
Figure 3:
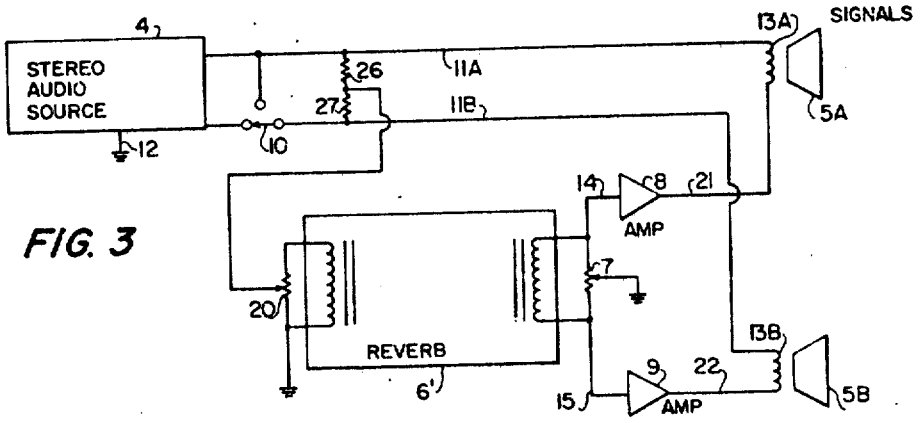

In this version it may sometimes be desirable to operate in monaural mode, as for example when weak signals make stereophonic reception noisy. Thus, switch 10 is provided to revert to monaural mode optionally by providing monaural signals into both speakers 5A, 5B and the reverberation unit 6'. As before mentioned, the various optional speaker connection of FIG. 2 may also be used in this embodiment (see FIG. 3A).

Therefore, having set forth significant improvements in the state of the art, those novel features believed descriptive of the nature and spirit of the invention are set forth with particularity in the appended claims.

What is claimed is:

1. An audio system for reproducing reverberation effects from a mixture of two signals derived from an audio source supplying a basic audio signal, comprising in combination, a reproduction device having a pair of input terminals coupled to a signal responsive impedance member, amplifier means with low internal impedance applying the basic audio signal to one of said pair of the input terminals of the impedance member, reverberation means modifying the basic audio signal, and means applying the modified audio signal in opposite phase to the other of said pair of terminals for processing therein by said impedance member and mixing therein with said basic audio signal, said impedance member having a higher impedance than said amplifier, means for attenuating feedback of the modified audio signal to the amplifier means, and comprising primarily the impedance member of the reproduction device.

2. A system as defined in claim 1 wherein the reproduction device is a loudspeaker.

3. A system as defined in claim 1 wherein the audio source is monaural.

4. A system as defined in claim 3 having two reproduction devices and wherein said means applying the modified signal comprises two amplifiers respectively applying the modified signal to the two reproduction devices.

5. A system as defined in claim 1 wherein the audio source is stereophonic with two reproduction devices, in which means coupling a single said signal modification unit to process signals from both channels, and having means coupling said modified audio signal to both said reproduction devices.

6. A system as defined in claim 1 including a plurality of at least two reproduction devices, with at least one reproduction device coupled to one terminal of the first said reproduction device to reproduce that basic audio signal, whereas the first said reproduction device reproduces the mixture of said two signals.

7. A system as defined in claim 1 including a plurality of at least two reproduction devices, with at least one reproduction device coupled to said other terminal of the first said reproduction device to reproduce only said modified audio signal.

8. A system as defined in claim 1 comprising a self-contained add-on unit replacing the reproduction device in an audio system of the type including radio receivers, phonographs and tape decks having an output amplifier of known output power capacity, wherein said add-on unit has two output reproduction devices coupled by two amplifiers in opposite phase to the output modified basic signal, said amplifiers having the same output power capacity as in said audio system.

9. A system as defined in claim 1 wherein the means modifying the basic audio signal has an output circuit with dual terminals respectively providing signals in opposite phase.

10. The method of mixing modified signals derived from an audio source for common reproduction with the audio signals in a single speaker having a voice coil of predetermined impedance comprising the steps of:

(a) providing an audio signal from the audio source with a low impedance device, (b) modifying the audio signal with low impedance reverberation means to produce a modified signal, and (c) feeding the modified signal and the audio signal into opposite ends respectively of said voice coil, thereby attenuating feedback of the modified signal to the audio source primarily by means of the voice coil impedance.

* * * * *

UNITED STATES PATENT AND TRADEMARK OFFICE

CERTIFICATE OF CORRECTION

PATENT NO. : 4,167,651

DATED : September 11, 1979

INVENTOR(S) : Robert B. Kempe

Figure 2A:
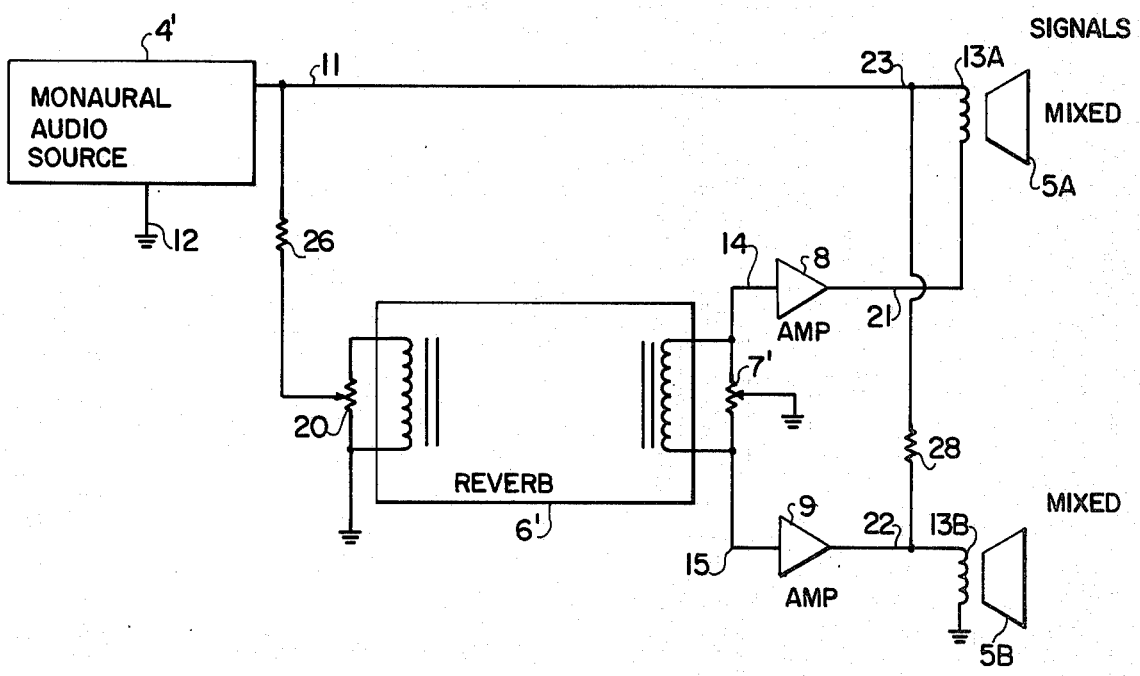
Figure 2B:
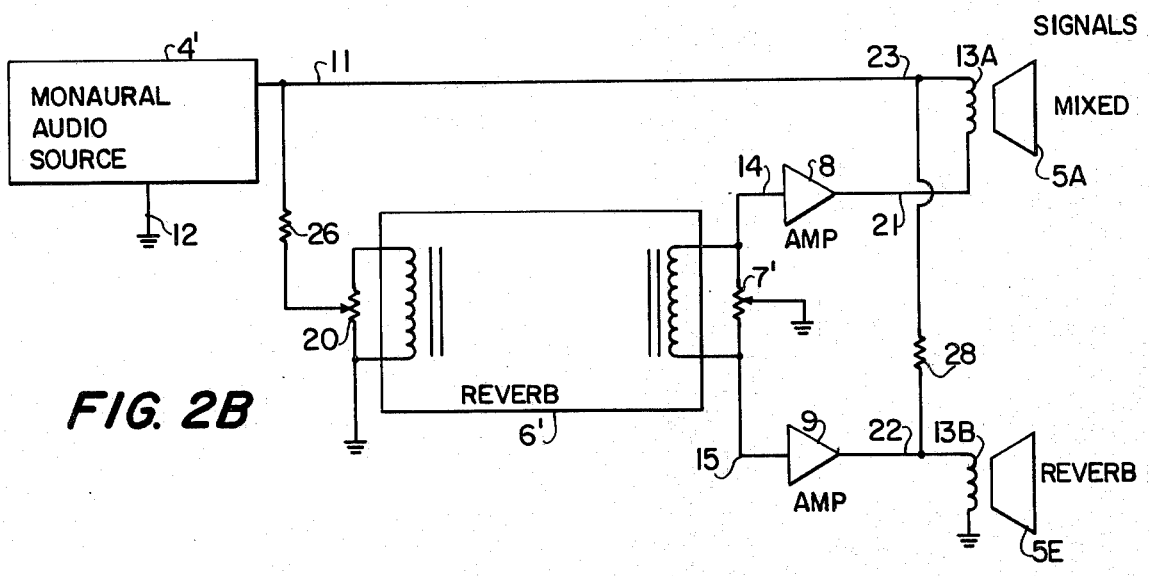
Figure 2C:
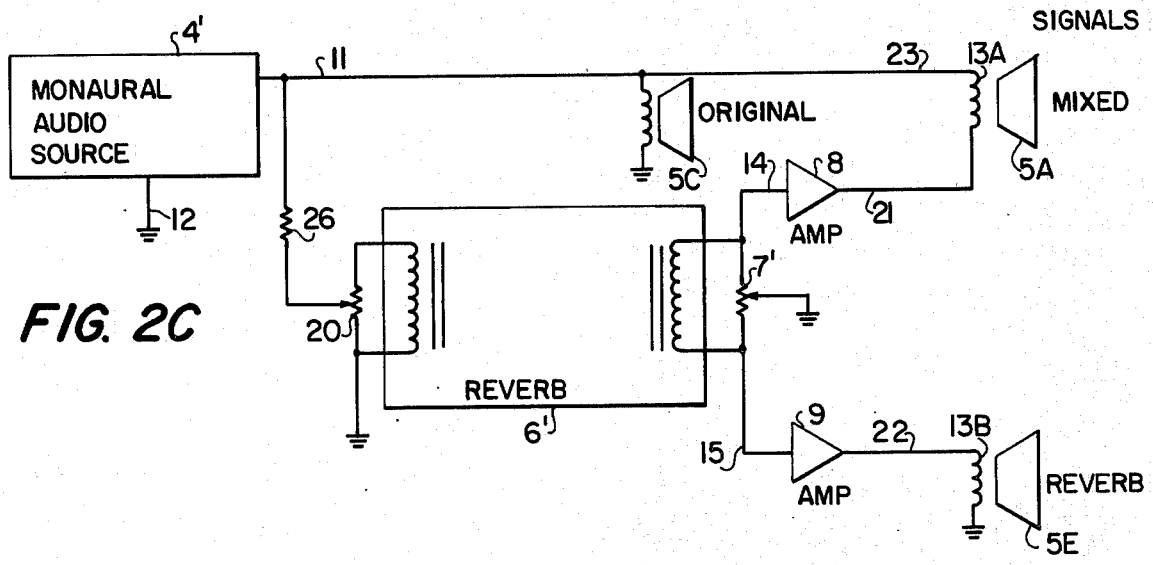

It is certified that error appears in the above—identified patent and that said Letters Patent is hereby corrected as shown below:

Figures 2A, 2B and 3 of the drawings should appear as per attached sheets.

Signed and Sealed this

Sixteenth Day of November 1982

[SEAL]

*Attest:*

GERALD J. MOSSINGHOFF

*Attesting Officer*

*Commissioner of Patents and Trademarks*